US011312561B2

(12) United States Patent
Murray

(10) Patent No.: US 11,312,561 B2
(45) Date of Patent: Apr. 26, 2022

(54) FLEXIBLE POUCH FOR TWO-COMPONENT PRODUCTS

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 0 days.

(21) Appl. No.: 15/360,446

(22) Filed: Nov. 23, 2016

(65) Prior Publication Data

US 2017/0144822 A1 May 25, 2017

Related U.S. Application Data

(60) Provisional application No. 62/259,690, filed on Nov. 25, 2015.

(51) Int. Cl.

| | |
|---|---|
| ***B65D 81/32*** | (2006.01) |
| ***B65D 30/22*** | (2006.01) |
| ***B65D 75/58*** | (2006.01) |
| ***B65D 75/00*** | (2006.01) |

(52) U.S. Cl.

CPC ..... *B65D 81/3266* (2013.01); *B65D 31/12* (2013.01); *B65D 75/008* (2013.01); *B65D 75/5805* (2013.01); *B65D 75/5866* (2013.01); *B65D 75/5883* (2013.01)

(58) Field of Classification Search

CPC ..... B65D 81/32; B65D 31/12; B65D 75/008; B65D 75/5805; B65D 75/5883; B65D 81/3266; B65D 75/5866

USPC ..... 206/219, 220; 383/38, 40

See application file for complete search history.

(56) References Cited

U.S. PATENT DOCUMENTS

| | | | | |
|---|---|---|---|---|
| 3,670,927 A * | 6/1972 | Hubbard | B65D 25/56 | 222/107 |
| 4,396,383 A * | 8/1983 | Hart | A61J 1/2093 | 604/404 |
| 4,465,488 A * | 8/1984 | Richmond | A61J 1/2093 | 604/414 |
| 4,952,068 A * | 8/1990 | Flint | B01F 5/0602 | 206/219 |
| 5,431,496 A * | 7/1995 | Balteau | A61M 1/1668 | 383/38 |
| 5,928,213 A * | 7/1999 | Barney | A61J 1/2093 | 604/410 |
| 6,039,720 A * | 3/2000 | Wieslander | A61J 1/2093 | 206/219 |
| 6,186,998 B1 * | 2/2001 | Inuzuka | B29C 66/4312 | 206/219 |

(Continued)

*Primary Examiner* — J. Gregory Pickett
*Assistant Examiner* — Jenine Pagan
(74) *Attorney, Agent, or Firm* — Dinsmore & Shohl LLP

(57) ABSTRACT

A flexible pouch for two-component products includes a front panel, a back panel and a pair of side seals. An upper compartment is formed between the front panel, the back panel, one of the pair of side seals, an intermediate side seal and a bottom frangible seal. A lower compartment is formed beneath the upper compartment between the front panel and the back panel. A vertical passage extends between the intermediate side seal and another of the pair of side seals from the lower compartment to an opening. Rupture of the bottom frangible seal provides a fluid passageway from the upper compartment to the lower compartment.

17 Claims, 8 Drawing Sheets

(56) References Cited

U.S. PATENT DOCUMENTS 6,645,191 B1 * 11/2003 Knerr ..... A61J 1/2093 604/410
7,055,683 B2 * 6/2006 Bourque ..... B29C 65/76 206/219
7,306,095 B1 * 12/2007 Bourque ..... B29C 65/76 206/219
8,118,158 B2 * 2/2012 Igota ..... A61J 1/2093 206/219
8,915,359 B2 * 12/2014 DiLiberto ..... B65D 81/3272 206/222
8,960,438 B2 2/2015 Murray
9,320,680 B2 * 4/2016 Schroder ..... A61J 1/2093
9,334,098 B1 * 5/2016 Hughes ..... B65D 81/3266
2002/0166779 A1 * 11/2002 Etesse ..... B65D 75/008 206/219
2003/0049354 A1 3/2003 Murray
2006/0127549 A1 6/2006 Murray
2006/0196784 A1 9/2006 Murray
2007/0278114 A1 * 12/2007 Kane ..... B65D 75/5883 206/219
2008/0002918 A1 * 1/2008 Steele ..... B31B 37/00 383/38
2011/0293202 A1 * 12/2011 Takeda ..... B65D 33/1691 383/6
2013/0126370 A1 * 5/2013 DiLiberto ..... B65D 81/3272 206/219
2013/0283736 A1 * 10/2013 VanLoocke ..... B65B 29/10 53/455
2013/0304016 A1 * 11/2013 Kouno ..... A61J 1/1475 604/410
2014/0212075 A1 * 7/2014 Cross ..... B65D 75/5883 383/64
2014/0319150 A1 * 10/2014 Flank ..... A61J 1/10 220/529
2016/0052705 A1 2/2016 Murray

* cited by examiner 20
252
264
260
226b
210
262
212
222
200
202
X
Y
240
268
270
266
206
224
226
225
204
250
226a

FLEXIBLE POUCH FOR TWO-COMPONENT PRODUCTS

CROSS-REFERENCE TO RELATED APPLICATIONS

The instant application claims priority to U.S. Provisional Application Ser. No. 62/259,690 filed Nov. 25, 2015, the entire contents of which are incorporated herein by reference.

FIELD OF THE INVENTION

The instant application is directed to a flexible pouch and particularly to a flexible pouch for containing two-component products.

BACKGROUND OF THE INVENTION

Many products have dry components which must be mixed with a liquid to be activated. The dry components may be packaged in a plastic or flexible pouch, e.g., a stand up flexible pouch. Mosquito control products may have dry components including yeast which can be activated upon adding water. The water reacts with the yeast to produce carbon dioxide which can draw mosquitoes to the carbon dioxide fumes and other chemicals used to control the insects. The water must be supplied from an external source measured and poured into the pouch. Such a two or more step procedure may be inconvenient. Accordingly, an improved flexible pouch for two-component products would be desirable.

SUMMARY OF THE INVENTION

A flexible pouch for two-component products includes a front panel, a back panel and a pair of side seals. An upper compartment is formed between the front panel, the back panel, one of the pair of side seals, an intermediate side seal and a bottom frangible seal. A lower compartment is formed beneath the upper compartment between the front panel and the back panel. A vertical passage extends between the intermediate side seal and another of the pair of side seals from the lower compartment to an opening. Rupture of the bottom frangible seal provides a fluid passageway from the upper compartment to the lower compartment.

In embodiments, the intermediate side seal is a permanent seal and the bottom frangible seal extends from the intermediate side seal to the one of the pair of side seals. The bottom frangible seal may provide a funnel shape from the upper compartment to the lower compartment and may be spaced apart from a bottom seal of the lower compartment. An aperture may extend through a top edge portion of the front panel and the back panel. The aperture may be positioned off-center along the top edge portions of the front and back panels such that the flexible pouch rotates to a tilted position when the flexible pouch is hanging from an object extending through the aperture.

In embodiments, a spout fitment is positioned in the opening and sealed between the front panel and the back panel. In other embodiments, a tear-off portion is positioned in the opening and may be used to open the flexible pouch. A strip of reflective tape may be attached to an inner surface of the vertical passage proximate to the opening.

A first product may be present in the upper compartment and a second product present in the lower compartment. Rupture of the bottom frangible seal releases the first product from the upper compartment to come into contact with the second product in the lower compartment such that a third product, e.g., a gas, is formed and flows through the vertical passage and out of the opening.

Additional features and advantages of flexible pouches described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein and together with the description serve to explain the principles and operations of the claimed subject matter.

DETAILED DESCRIPTION OF THE PREFERRED EMBODIMENTS

Referring to FIGS. 1-7, a flexible pouch for containing two separate products that may be brought into contact with each other upon rupture of an internal frangible seal is provided. The flexible pouch includes a front panel, a back panel and a pair of side seals. An upper compartment is formed between the front panel, the back panel, one of the pair of side seals and an intermediate side seal positioned between the pair of side seals. A bottom frangible seal may separate the upper compartment from a lower compartment that is formed beneath the upper compartment between the front panel and the back panel. A vertical passage extends between the intermediate side seal and another of the pair of side seals from the lower compartment to an opening. Breaking through or rupturing of the bottom frangible seal provides a fluid passageway from the upper compartment to the lower compartment. A first product contained within the upper compartment may flow into the lower compartment containing a second product when the frangible seal is ruptured. Contact of the first product with the second product may generate or result in the creation of a desired third product. For example and without limitation, the first product may be a liquid, solid or gas, the second product may be a liquid, solid, or gas, and the third product may be a solid, liquid or gas that is formed when the first product comes into contact with the second product. The third product, e.g., a gas, can flow through the vertical passage and out of the opening in order to be released from or exit the flexible pouch.

Figure 1:
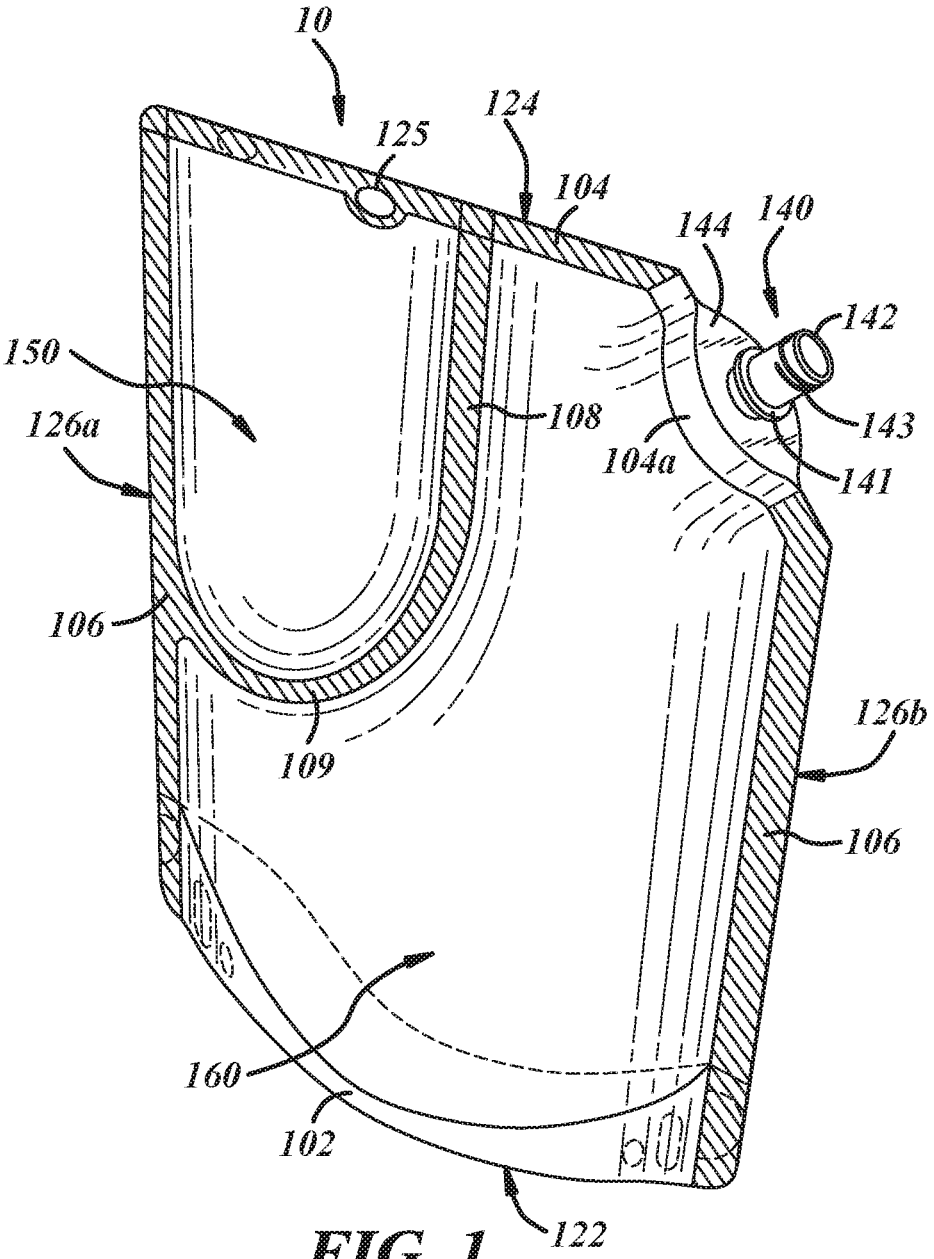
FIG. 1 is a perspective view of a two-component flexible pouch according to one or more embodiments disclosed and described herein.
Figure 3:
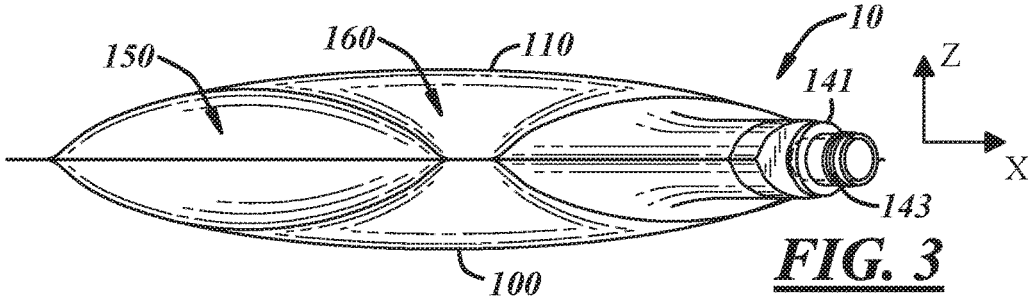
FIG. 3 is a top view of the flexible pouch depicted in FIG. 1.
Figure 2:
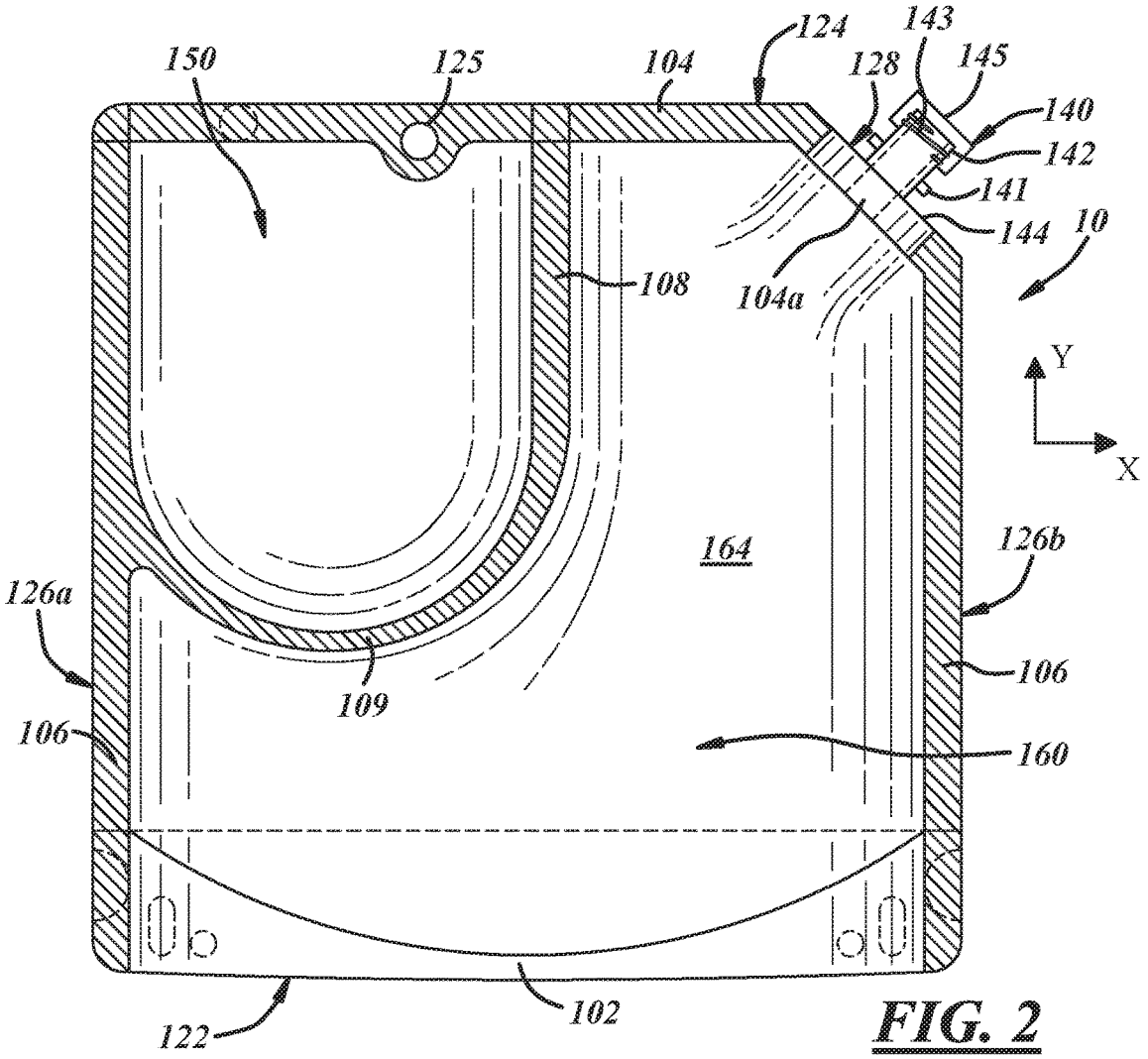
FIG. 2 is a side view of the flexible pouch depicted in FIG. 1.
Figure 7:
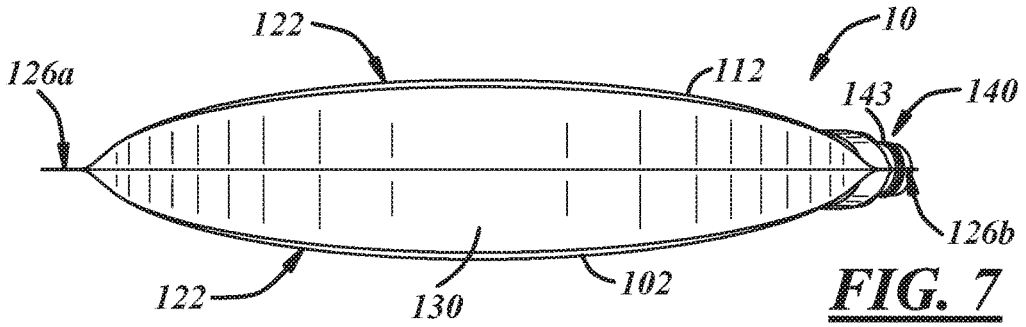
FIG. 7 is a bottom view of the flexible pouch depicted in FIG. 1.
Figures 4, 5, 6:
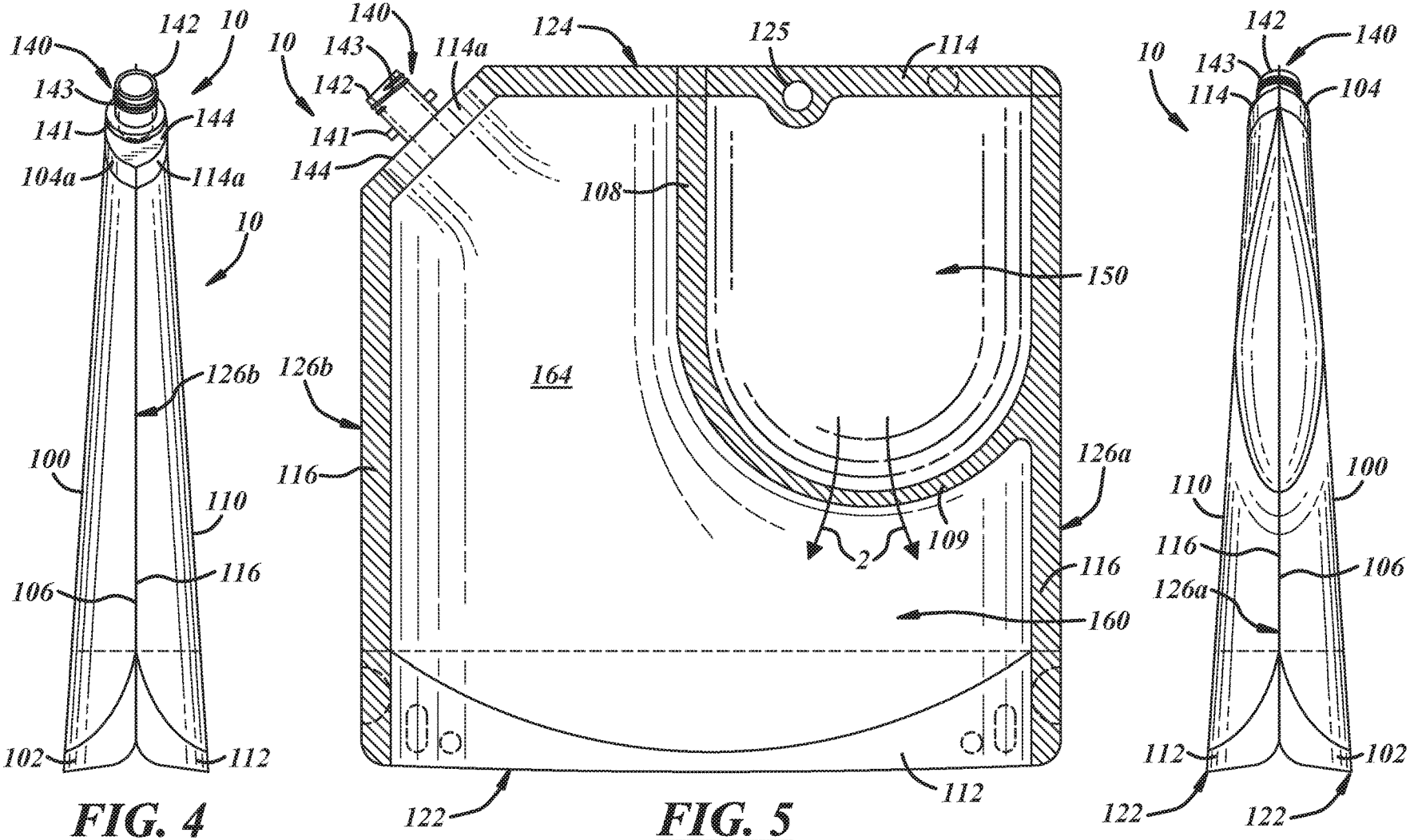
FIG. 4 is a front view of the flexible pouch depicted in FIG. 1.
FIG. 5 is another side view of the flexible pouch depicted in FIG. 1.
FIG. 6 is a rear view of the flexible pouch depicted in FIG. 1.

Still referring to FIGS. 1-7, a two-compartment flexible pouch 10 includes a front panel 100 and a back panel 110. The front panel 100 may have a bottom edge portion 102, a top edge portion 104 and a pair of side edge portions 106 (FIG. 2). The back panel 110 may have a bottom edge portion 112, a top edge portion 114 and a pair of side edge portions 116 (FIG. 5). The front panel 100 may be attached to the back panel 110 with a bottom seal 122, a top seal 124 and a pair of side seals 126*a*, 126*b*. In embodiments, a gusset 130 (FIG. 7) can be positioned between the bottom edge portion 102 of the front panel 100 and the bottom edge portion 112 of the back panel 110 such that a stable base for the flexible pouch 10 is provided. That is, the gusset 130 may be attached to the bottom edge portions 102, 112 with the bottom seal 122 such that the flexible pouch 10 can stand or remain upright as depicted in FIGS. 1, 4, and 6.

In embodiments, the bottom seal 122, top seal 124 and pair of side seals 126*a*, 126*b* may be formed from a seal, e.g., a heat seal, that joins the bottom edge portions 102, 112 together, the top edge portions 104, 114 together and the side edge portions 106, 116 together. In other embodiments, one or more of the bottom seal 122, top seal 124 and pair of side seals 126*a*, 126*b* may be formed from a fold line created by folding a single panel to form the front panel 100 and back panel 110. Accordingly, the term "seal" as used herein refers to a boundary of an interior of the flexible pouch and may be formed by joining a portion of a front panel to a portion of a back panel, e.g., via a heat seal, or in the alternative, may be formed by folding a single panel to form a front panel and a back panel with a fold line there between.

The flexible pouch 10 may include an upper compartment 150 formed between the front panel 100, the back panel 110, one of the pair of side seals 126*a*, an intermediate side seal 108, and a bottom frangible seal 109. The bottom frangible seal 109 may extend from and between the intermediate side seal 108 to the side seal 126*a*. The flexible pouch 10 also includes a lower compartment 160 formed beneath the upper compartment 150 between the front panel 100 and the back panel 110. The flexible pouch 10 may also include a vertical passage 164 extending between the intermediate side seal 108 and another of the pair of side seals 126*b* from the lower compartment 160 to an opening 140. Rupture of the bottom frangible seal 109 provides a fluid passageway between the upper compartment 150 and the lower compartment 160. The bottom frangible seal 109 is designed and configured to rupture when a predetermined amount of force is applied thereto as described in greater detail below. The intermediate side seal 108 may be a permanent seal designed and configured not to rupture when force applied to the flexible pouch 10 ruptures the bottom frangible seal 109. The bottom frangible seal 109 may have an arcuate shape and provide a funnel shape from the upper compartment 150 to the lower compartment 160. In this manner, a product contained within the upper compartment 150 may fully drain or flow from the upper compartment 150 into the lower compartment 160. Also, the bottom frangible seal may be spaced apart from the bottom seal 122 of the flexible pouch 10 such that sufficient space or volume is provided for a product contained within the upper compartment 150 to flow into the lower compartment 160. For example, and without limitation, the bottom frangible seal 109 may be spaced apart from the bottom seal 122 between about 25% to about 50% of the overall height (Y direction) of the flexible pouch 10.

Figure 8:
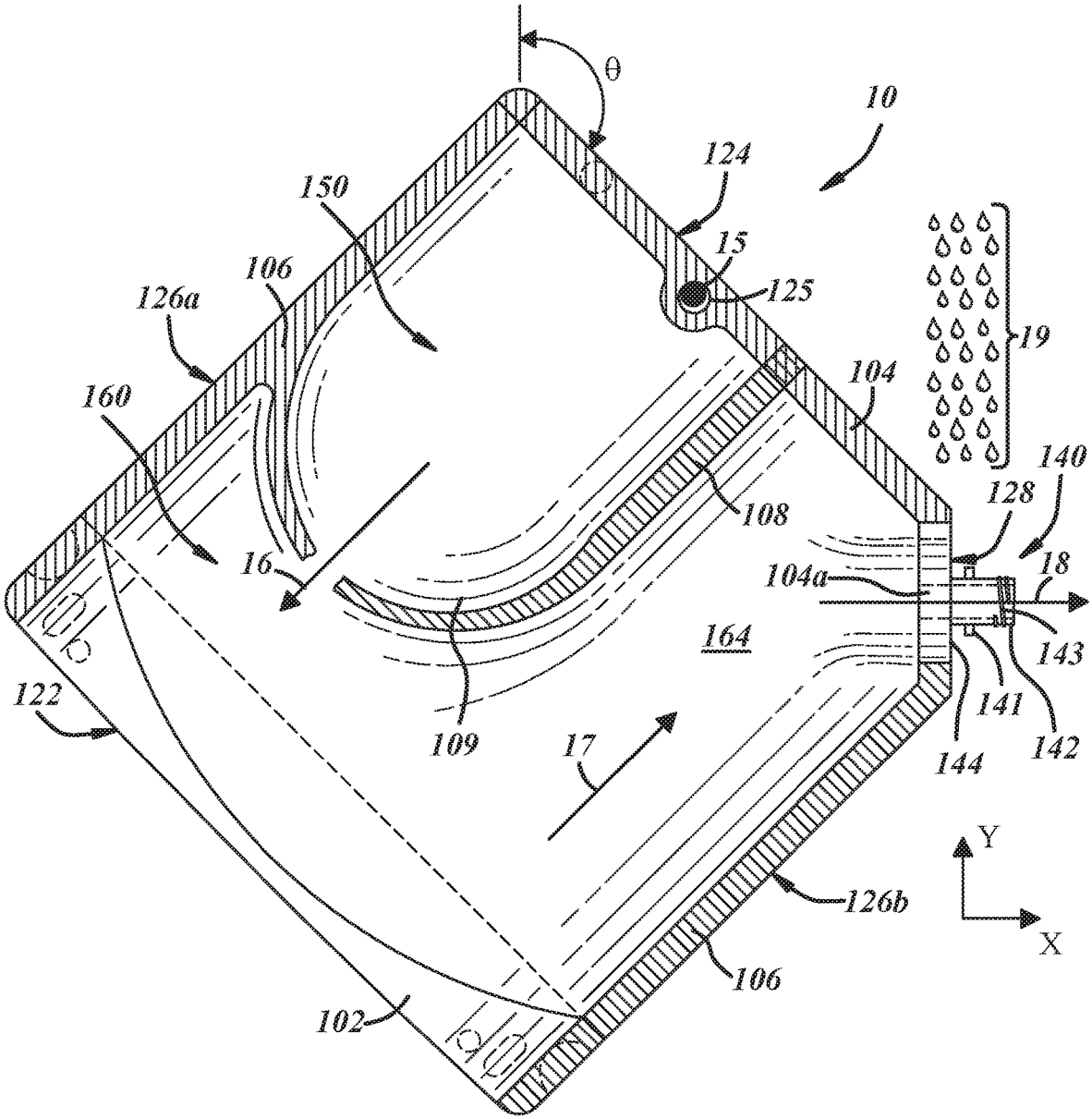
FIG. 8 is a side view of the flexible pouch depicted in FIG. 2 hanging in a tilt position according to one or more embodiments disclosed and described herein.

In embodiments, an aperture 125 extends through the top seal 124. The position of the aperture 125 along the top seal 124 is off-center along the width (X direction) of the flexible pouch 10. The off-center position of the aperture 125 along the width (X direction) of the top seal 124 is configured for the flexible pouch 10 to rotate from a stand-up position as depicted in FIG. 2 to a tilt position as depicted in FIG. 8 when the flexible pouch 10 is hung from an object 15 such as a rod, pin, nail, etc., extending through the aperture 125. That is, hanging the flexible pouch 10 with the object 15 extending through the aperture 125 results in the flexible pouch 10 rotating in a tilt position such that the opening 140 rotates in a downwardly direction (−Y direction). In embodiments, the opening 140 rotates in a downwardly direction between about 15 degrees to about 75 degrees. In other embodiments, the opening 140 rotates in a downwardly direction between about 30 degrees to about 60 degrees. Rotation of the flexible pouch 10 in a downwardly direction may prevent objects 19 from falling within the opening 140 as described in greater detail below.

In embodiments, a spout fitment 142 is positioned within the opening 140. The spout fitment 142 may have a flange 141, threads 143 and a base portion 144 that is sealed to an opening edge 104*a* of the front panel 100 and an opening edge 114*a* of the back panel 110 with a seal 128. A cap 145 can be attached to the spout fitment 142 and removed once the bottom frangible seal 109 has been ruptured and the first product has come into contact with the second product. In embodiments the cap 145 has threads (not shown) that engage the threads 143 of the spout fitment 142 for securement of the cap 145 to the spout fitment 142. The spout fitment 142 with the cap 145 allows for storage of the flexible pouch 10 and any products that may be contained within the upper compartment 150 and the lower compartment 160.

The flexible pouch 10 may be formed and filled by attaching the front panel 100 to the back panel 110 with the bottom seal 122 and side seals 126*a*, 126*b* using a flexible pouch manufacturing machine (not shown). The intermediate side seal 108 and bottom frangible seal 109 may be formed such that the upper compartment 150, lower compartment 160 and vertical passage 164 are provided. The upper compartment 150 may be filled with a desired quantity of a first product, for example and without limitation a liquid or a solid, at a first filling station on the flexible pouch manufacturing machine. The top seal 124 may be formed across an upper portion of the flexible pouch 10 such that the first product is sealed within the upper compartment 150. The flexible pouch may be moved to a second filling station where a diving tube (not shown) is inserted into the vertical passage 164 and/or lower compartment 160 through the spout fitment 142. The lower compartment 160 may be filled with a desired amount of a second product, for example and without limitation a liquid or a solid, through the diving tube and the cap 145 may be attached to the spout fitment 142 to seal the second product within the lower compartment 160.

Referring now to FIG. 8, in use the flexible pouch 10 may include a first product contained within the upper compartment 150 and a second product contained in the lower compartment 160. The first product may be a solid such as, without limitation, yeast, and the second product may be a liquid such as, without limitation, water. The bottom frangible seal 109 is ruptured by applying a compressive force on the upper compartment 150. For example and without limitation, grasping and rolling the upper compartment 150 from the top seal 124 towards the bottom frangible seal 109 may create an internal pressure within the upper compartment 150 that exerts a force on the bottom frangible seal 109. Upon reaching a predefined force that is greater than a sealing force provided by the bottom frangible seal 109, the bottom frangible seal 109 ruptures which forms a fluid passageway from the upper compartment 150 to the lower compartment 160. Once the fluid passageway from the upper compartment 150 to the lower compartment 160 is created, the first product contained within the upper compartment 150 flows from the upper compartment 150 into the lower compartment 160 as depicted by arrow 16 and comes into contact and/or mixes with the second product and a third product is produced. The third product, e.g., a gas such as and without limitation carbon dioxide, exits the flexible pouch 10 by flowing up through the vertical passage 164 as depicted by arrow 17 and out through the opening 140 as depicted by arrow 18. The third product may attract insects such as, and without limitation, mosquitoes to the flexible pouch 10. The flexible pouch 10 can be hung (suspended) with the object 15 extending through the aperture 125 and the opening 140 rotates downwardly as described above. Upon rotating to a downward position, objects such rain, leaves, etc. are prevented from falling within the opening 140, thereby protecting the contents within the flexible pouch 10.

Figure 9:
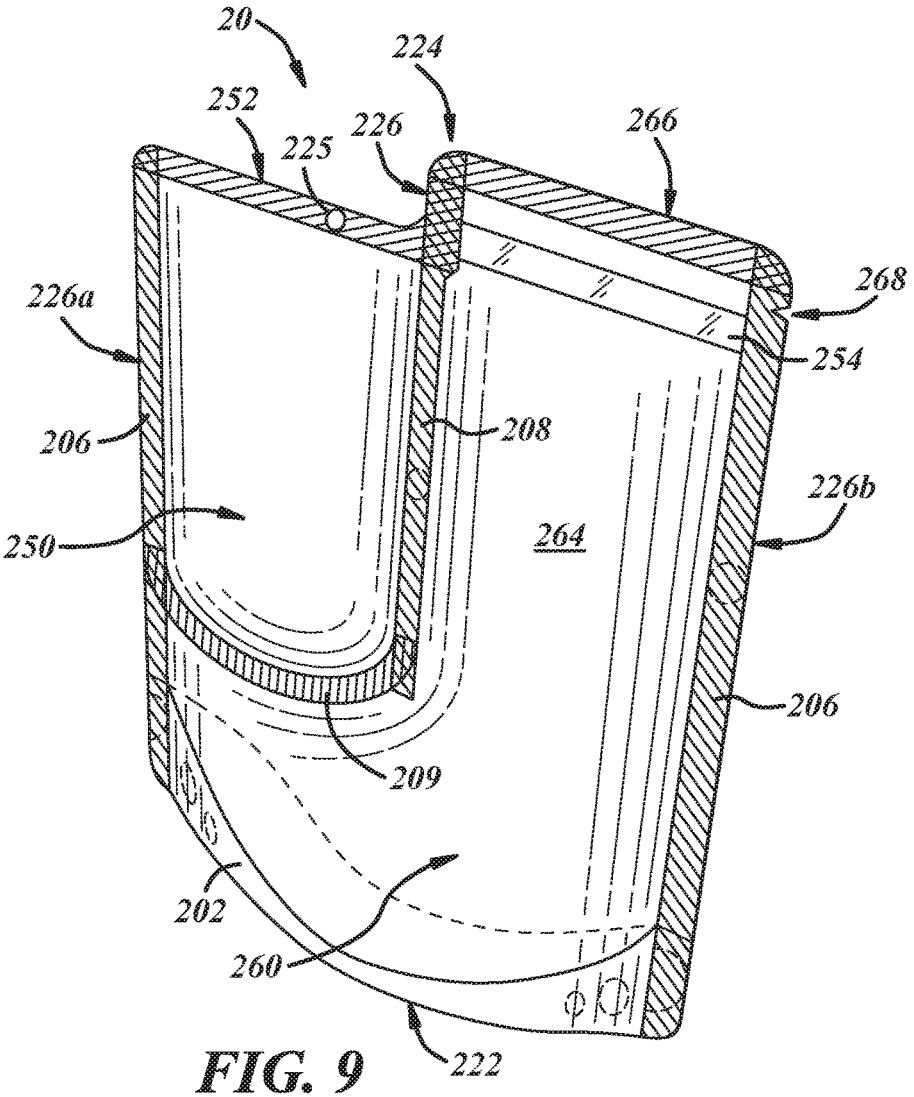
FIG. 9 is a perspective view of a two-compartment flexible pouch according to one or more embodiments disclosed and described herein.
Figure 11:
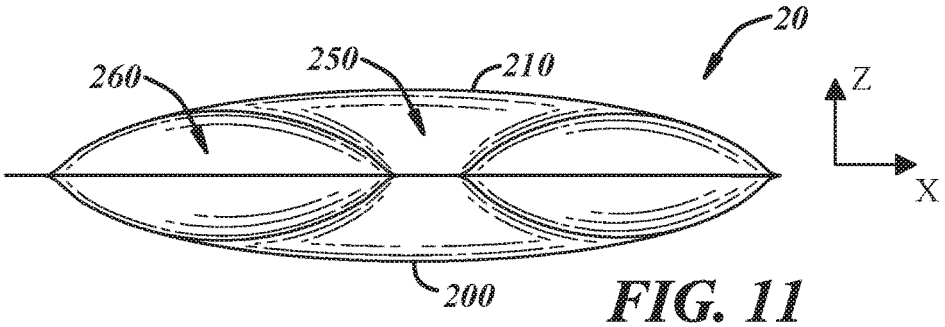
FIG. 11 is a top view of the flexible pouch depicted in FIG. 9.
Figures 10, 12, 14:
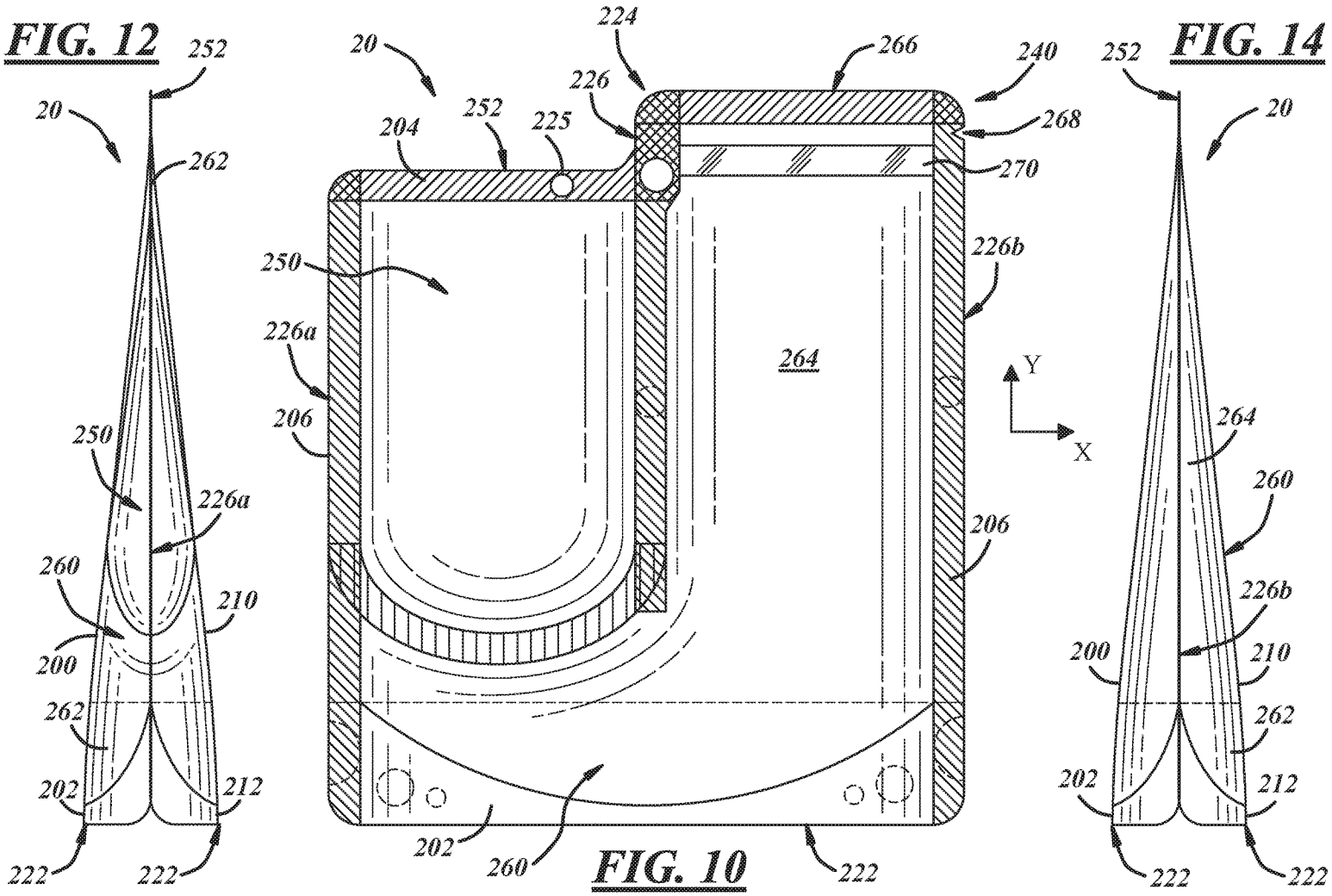
FIG. 10 is a side view of the flexible pouch depicted in FIG. 9.
FIG. 12 is a rear view of the flexible pouch depicted in FIG. 9.
FIG. 14 is a front view of the flexible pouch depicted in FIG. 9.
Figure 13:
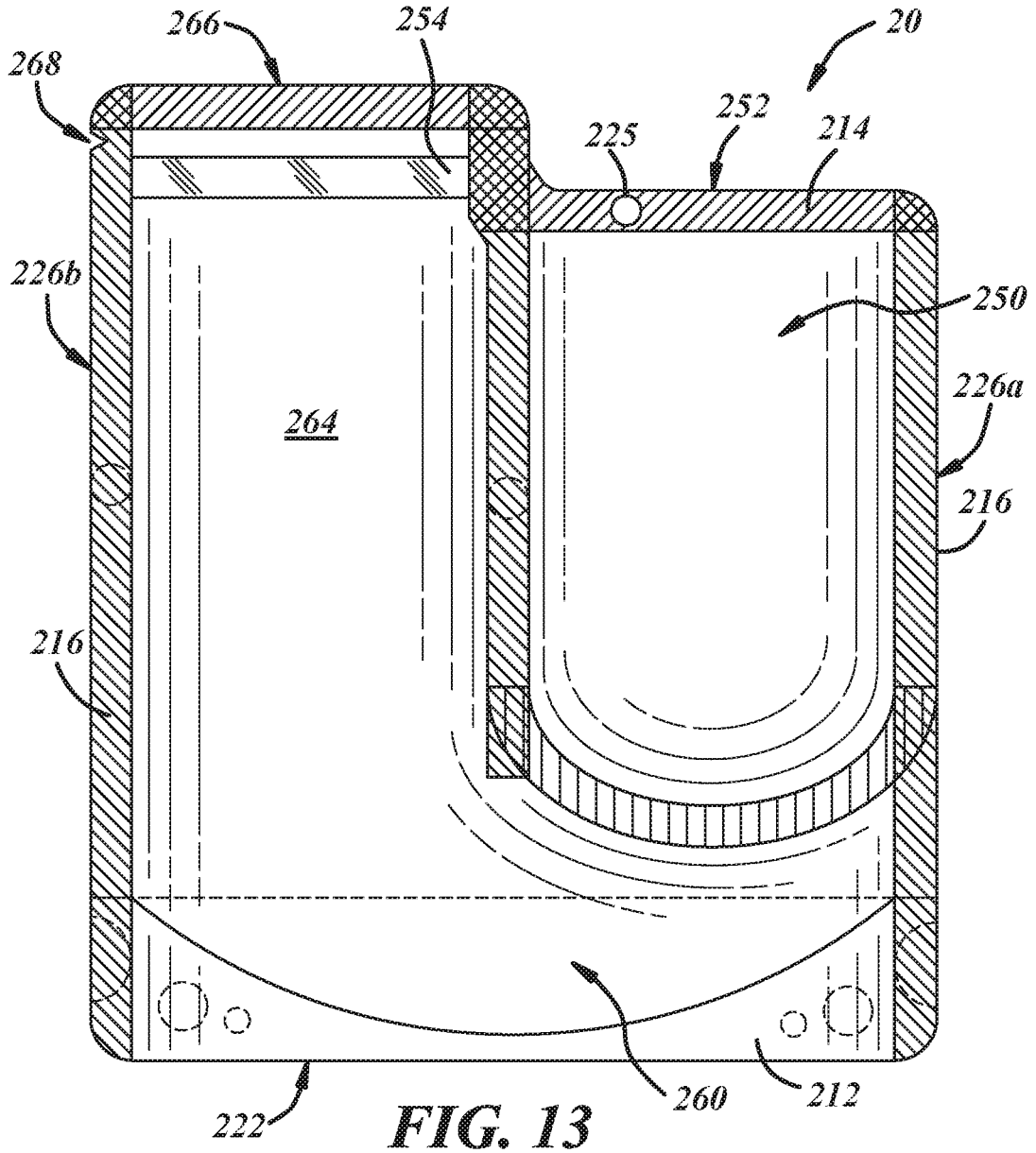
FIG. 13 is another side view of the flexible pouch depicted in FIG. 9.
Figure 15:
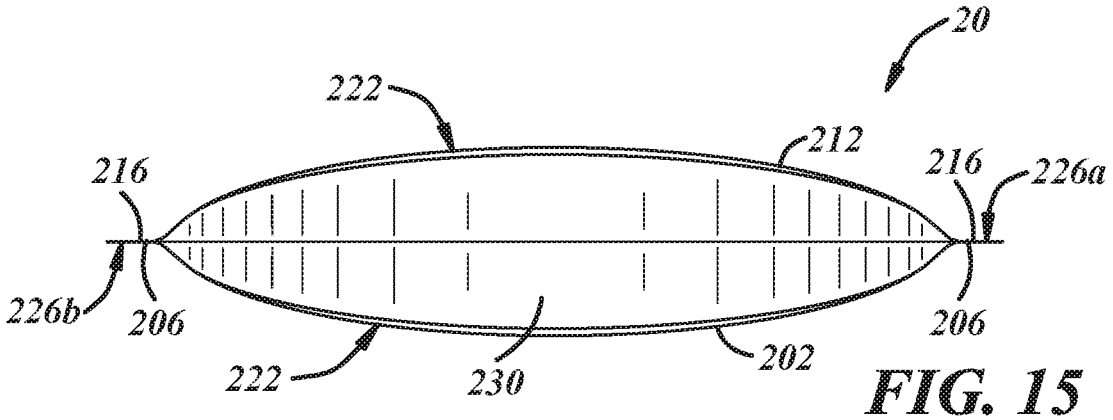
FIG. 15 is a bottom view of the flexible pouch depicted in FIG. 9.

Referring now to FIGS. 9-15, another embodiment of a two-compartment flexible pouch is shown generally at reference numeral 20. The flexible pouch 20 includes a front panel 200 and a back panel 210. The front panel 200 may have a bottom edge portion 202, a top edge portion 204 and a pair of side edge portions 206 (FIG. 10). The back panel 210 may have a bottom edge portion 212, a top edge portion 214 and a pair of side edge portions 216 (FIG. 13). The front panel 200 may be attached to the back panel 210 with a bottom seal 222, a top seal 224 and a pair of side seals 226*a*, 226*b*. In embodiments, a gusset 230 (FIG. 15) can be positioned between the bottom edge portion 202 of the front panel 200 and the bottom edge portion 212 of the back panel 210 such that a stable base for the flexible pouch 20 is provided. That is, the gusset 230 may be attached to the bottom edge portions 202, 212 with the bottom seal 222 such that the flexible pouch 20 can stand or remain upright as depicted in FIGS. 9, 12, and 14.

In embodiments, the bottom seal 222, top seal 224 and pair of side seals 226*a*, 226*b* may be formed from a seal, e.g., a heat seal, that joins the bottom edge portions 202, 212 together, the top edge portions 204, 214 together and the side edge portions 206, 216 together. In other embodiments, one or more of the bottom seal 222, top seal 224 and pair of side seals 226*a*, 226*b* may be formed from a fold line created by folding a single panel to form the front panel 200 and the back panel 210.

The flexible pouch 20 may include an upper compartment 250 formed between the front panel 200, the back panel 210, one of the pair of side seals 226*a*, an intermediate side seal 208, and a bottom frangible seal 209. The bottom frangible seal 209 may extend from and between the intermediate side seal 208 to the side seal 226*a*. An upper compartment top seal 252 may extend across an upper portion of the upper compartment 250. The flexible pouch 20 also includes a lower compartment 260 formed beneath (−Y direction) the upper compartment 250 between the front panel 200 and the back panel 210. The flexible pouch 20 may also include a vertical passage 264 extending between the intermediate side seal 108 and another of the pair of side seals 226*b* from the lower compartment 260 to an opening 240. A vertical passage top seal 266 may extend across an upper portion of the vertical passage 264. The vertical passage top seal 266 may be positioned above (+Y direction) the upper compartment top seal 252 as depicted in FIGS. 9, 10, and 13. A vertical seal 226 may extend from the upper compartment top seal 252 to the vertical passage top seal 266. Rupture of the bottom frangible seal 209 provides a fluid passageway between the upper compartment 250 and the lower compartment 260. The bottom frangible seal 209 is designed and configured to rupture when a predetermined amount of force is applied thereto as described in greater detail below. The intermediate side seal 208 may be a permanent seal designed and configured not to rupture when force applied to the flexible pouch 20 ruptures the bottom frangible seal 209. The bottom frangible seal 209 may have an arcuate shape and provide a funnel shape from the upper compartment 250 to the lower compartment 260. In this manner, a product contained within the upper compartment 250 may fully drain or flow from the upper compartment 250 into the lower compartment 260. Also, the bottom frangible seal 209 may be spaced apart from the bottom seal 222 of the flexible pouch 20 such that sufficient space or volume is provided for a product contained within the upper compartment 250 to flow into the lower compartment 260. For example, and without limitation, the bottom frangible seal 209 may be spaced apart from the bottom seal 222 between about 25% to about 50% of the overall height (Y direction) of the flexible pouch 20.

Figure 16:
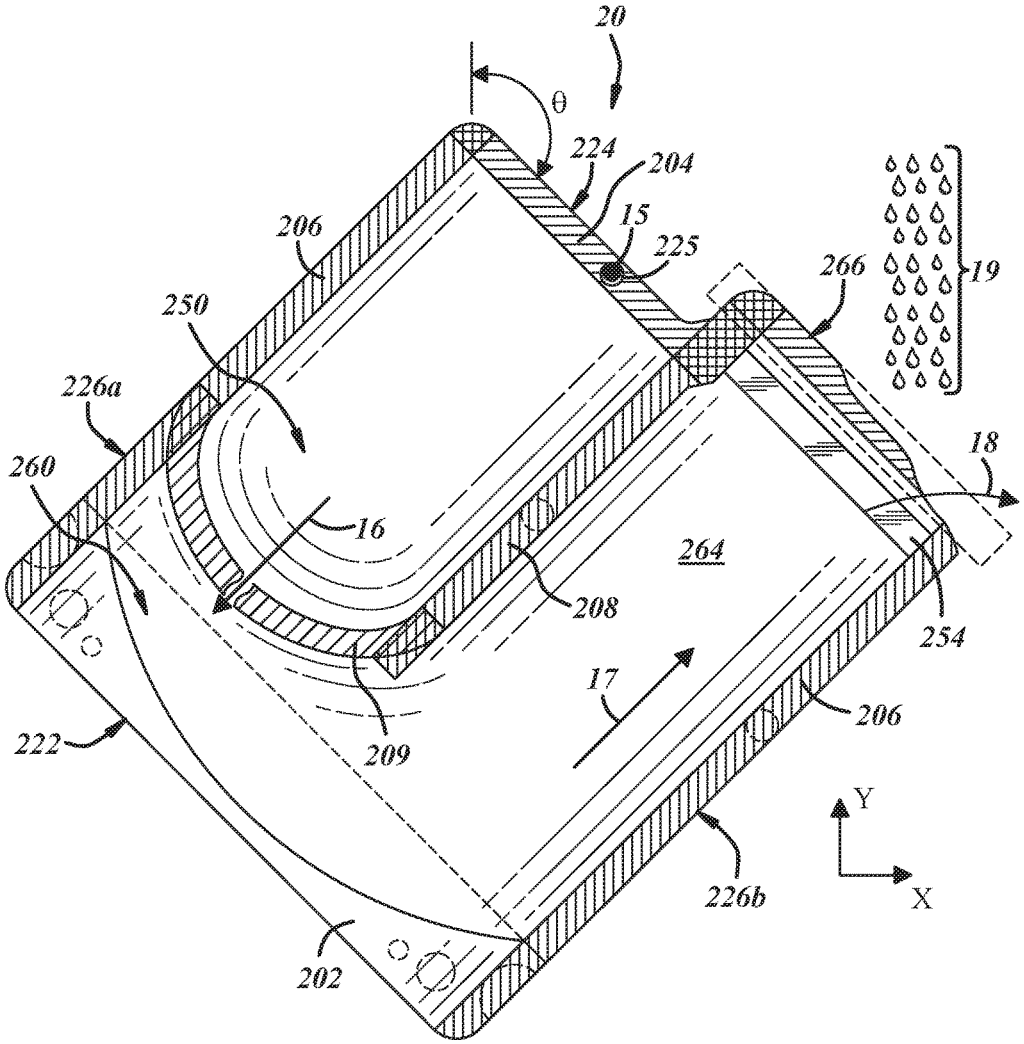
FIG. 16 is a side view of the flexible pouch depicted in FIG. 9 hanging in a tilt position according to one or more embodiments disclosed and described herein.

In embodiments, an aperture 225 extends through the top seal 224. The position of the aperture 225 along the top seal 224 is off-center along the width (X direction) of the flexible pouch 20. The off-center position of the aperture 225 along the width of the top seal 224 is configured for the flexible pouch 20 to rotate from a stand-up position as depicted in FIG. 10 to a tilt position as depicted in FIG. 16 when the flexible pouch 20 is hung from an object 25 such as a rod, pin, nail, etc., extending through the aperture 225. That is, hanging the flexible pouch 20 with the object 25 extending through the aperture 225 results in the flexible pouch 20 rotating in a tilt position such that the opening 240 rotates in a downwardly direction (−Y direction). In embodiments, the opening 240 rotates in a downwardly direction between about 15 degrees to about 75 degrees. In other embodiments, the opening 240 rotates in a downwardly direction between about 30 degrees to about 60 degrees. Rotation of the flexible pouch 20 in a downwardly direction may prevent objects 19 from falling within the opening 240 as described in greater detail below.

In embodiments, the opening 240 includes the vertical passage top seal 266 and a tear-away notch 268 within the side seal 226*b*. The tear-away notch 268 affords for the vertical passage top seal 266 to be at least partially removed from the flexible pouch 20 such that a fluid passageway from the vertical passage 264 to an exterior of the flexible pouch 20 is provided. A reflective tape 270 may be attached to an inner surface of the vertical passage 264. In embodiments, the reflective tape 270 may attract insects to the opening 240. The vertical passage top seal 266 may be removed once the bottom frangible seal 209 has been ruptured and the first product has come into contact with the second product. The vertical passage top seal 266 allows for storage of the flexible pouch 20 and any products that may be contained within the upper compartment 250 and the lower compartment 260.

Referring now to FIG. 16, in use the flexible pouch 20 may include a first product contained within the upper compartment 250 and a second product contained in the lower compartment 260. The first product may include a solid such as, without limitation, yeast, and the second product may include a liquid such as, without limitation, water. The bottom frangible seal 209 is ruptured by applying a compressive force on the upper compartment 150. For example and without limitation, grasping and rolling the upper compartment 250 from the top seal 224 towards the bottom frangible seal 209 may create an internal pressure within the upper compartment 250 that exerts a force on the bottom frangible seal 209. Upon reaching a predefined force that is greater than a sealing force provided by the bottom frangible seal 209, the bottom frangible seal 209 ruptures a fluid passageway from the upper compartment 250 to the lower compartment 260 is created. Once the fluid passageway from the upper compartment 250 to the lower compartment 260 is created, the first product contained within the upper compartment 250 flows from the upper compartment 250 into the lower compartment 260 as depicted by arrow 16 and comes into contact and/or mixes with the second product and a third product is produced. A user may grasp the side seal 226*b* proximate the tear-away notch 268, grasp the upper seal proximate the tear-away notch 268 and upon pulling on the vertical passage top seal 266 in a direction away from the side seal 226*b* (−X direction) remove at least a portion of the vertical passage top seal 266 as depicted in FIG. 16. The third product, e.g., a gas such as without limitation carbon dioxide, exits the flexible pouch 20 by flowing up through the vertical passage 264 and out through the opening 240 after the vertical passage top seal 266 has been at least partially removed from the flexible pouch 20. The third product may attract insects such as, and without limitation, mosquitoes to the flexible pouch 20. The flexible pouch 20 can be hung (suspended) with the object 15 extending through the aperture 225 and the opening 240 rotates downwardly as described above. The reflective tape 270 may be visible from outside the flexible pouch 20 and may assist in attracting insects such as, and without limitation, mosquitoes to the flexible pouch 20. Upon rotating to a downward position, the opening 240 is at least partially protected from objects such as rain, leaves, etc. falling and entering the opening 240, thereby protecting the contents within the flexible pouch 20.

Based on the foregoing, it should now be understood that the flexible pouches and methods described herein can be used to for two-component products that may be brought into contact with each other to produce a third product. The use of the flexible pouches provides an upper compartment for containing a first product and a lower compartment for containing a second product. A frangible seal is positioned between the upper compartment and the lower compartment and when the frangible seal is broken, e.g., ruptured, a fluid passage way is formed between the upper compartment and the lower compartment. The fluid passageway allows the first product to flow from the upper compartment to the lower compartment and come into contact with the second product. Contact of the first product with the second product may generate or result in the creation of a desired third product. The third product may be allowed to escape of exit the flexible pouch through an opening by flowing from the lower compartment through a vertical passage extending from the lower compartment to the opening.

It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

The invention claimed is:

1. A flexible pouch comprising:

a front panel and a back panel;

a pair of side seals;

a permanent intermediate side seal and an arcuate bottom frangible seal defining an upper compartment formed between the front panel, the back panel, and one of the pair of side seals, the permanent intermediate side seal disposed between the pair of side seals, the bottom frangible seal extending between the permanent intermediate side seal and the one of the pair of side seals, the bottom frangible seal is continuously arcuate and is curved downwardly extending from the permanent intermediate side seal and the one of the pair of side seals;

a lower compartment formed beneath the upper compartment between the front panel and the back panel; and a vertical passage extending between the permanent intermediate side seal and another of the pair of side seals from the lower compartment to an opening, wherein rupture of the bottom frangible seal defines a funnel that provides a fluid passageway from the upper compartment to the lower compartment; and wherein a portion of the arcuate bottom frangible seal ruptures to define the funnel by applying a compressive force on the upper compartment and the permanent intermediate side seal does not rupture when the compressive force is applied on the upper compartment.

2. The flexible pouch of claim 1, wherein the bottom frangible seal extends from the permanent intermediate side seal.

3. The flexible pouch of claim 1, wherein the bottom frangible seal provides a funnel shape from the upper compartment to the lower compartment.

4. The flexible pouch of claim 1, wherein the bottom frangible seal is spaced apart from the bottom seal.

5. The flexible pouch of claim 1, further comprising an aperture extending through a top edge portion of the front panel and the back panel, wherein the aperture is positioned off-center along the top edge portion such that the flexible pouch rotates to a tilted position when the flexible pouch is hanging from an object extending through the aperture.

6. The flexible pouch of claim 1, further comprising a spout fitment positioned in the opening and attached between the front panel and the back panel.

7. The flexible pouch of claim 1, further comprising a tear-off portion positioned in the opening.

8. The flexible pouch of claim 7, further comprising a strip of reflective tape proximate the tear-off portion on an interior surface of at least one of the front panel and the back panel.

9. The flexible pouch of claim 1, wherein the one of the pair of side seals is a permanent seal.

10. A flexible pouch comprising:

a front panel, a back panel, and two compartments for containing two products between a pair of side seals, the front panel and the back panel, the two compartments comprising:

an upper compartment formed between the front panel, the back panel, one of the pair of side seals, a permanent intermediate side seal positioned between the pair of side seals and an arcuate bottom frangible seal, the arcuate bottom frangible seal is continuously arcuate and is curved downwardly extending from the permanent intermediate side seal and one of the pair of side seals;

a lower compartment formed beneath the upper compartment between the front panel, the back panel, the bottom frangible seal and a bottom seal; and a vertical passage formed between the front panel, the back panel and another of the pair of side seals, the vertical passage extending between the permanent intermediate side seal and the another of the pair of side seals from the lower compartment to an opening;

wherein a portion of the arcuate bottom frangible seal ruptures to define a funnel that provides a fluid passageway from the upper compartment to the lower compartment by applying a compressive force on the upper compartment and the permanent intermediate side seal does not rupture when the compressive force is applied on the upper compartment.

11. The flexible pouch of claim 10, wherein the bottom frangible seal is spaced apart from the bottom seal.

12. The flexible pouch of claim 10, wherein the bottom frangible seal provides a funnel shape from the upper compartment to the lower compartment.

13. The flexible pouch of claim 10, further comprising a spout fitment positioned in the opening and attached between the front panel and the back panel.

14. The flexible pouch of claim 10, further comprising a tear-off portion positioned in the opening.

15. The flexible pouch of claim 14, further comprising a strip of reflective tape attached to an interior surface of the vertical passage proximate the opening.

16. The flexible pouch of claim 10, wherein the one of the pair of side seals is a permanent seal.

17. The flexible pouch of claim 10, further comprising an aperture extending through a top seal, wherein the aperture is positioned off-center along the top seal such that the flexible pouch rotates to a tilted position when the flexible pouch is hanging from an object extending through the aperture.

* * * * *